US006511956B1

(12) United States Patent
Wen et al.

(10) Patent No.: US 6,511,956 B1
(45) Date of Patent: Jan. 28, 2003

(54) PROCESS FOR FORMING A CLEANING COMPOSITION

(75) Inventors: Tianli Wen, Chicago, IL (US); Manivannan Kandasamy, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/856,589

(22) PCT Filed: Nov. 25, 1998

(86) PCT No.: PCT/US98/25160

§ 371 (c)(1), (2), (4) Date: Jun. 19, 2001

(87) PCT Pub. No.: WO00/31226

PCT Pub. Date: Jun. 2, 2000

(51) Int. Cl.[7] ..... C11D 3/37; C11D 11/02; C11D 11/04

(52) U.S. Cl. ..... 510/452; 510/351; 510/357; 510/426; 510/475

(58) Field of Search ..... 510/351, 357, 510/426, 452, 475

(56) References Cited

FOREIGN PATENT DOCUMENTS

| | | | | |
|---|---|---|---|---|
| EP | 0 619 289 A1 | | 10/1994 | |
| EP | 0 688 862 A1 | | 12/1995 | |
| WO | WO 98/08925 | * | 3/1998 | ..... C11D/3/37 |
| WO | WO 98/08928 | | 3/1998 | |
| WO | WO 00/31226 | * | 6/2000 | ..... C11D/3/37 |

* cited by examiner

*Primary Examiner*—Mark Kopec
*Assistant Examiner*—Brian P. Mruk
(74) *Attorney, Agent, or Firm*—Brahm J. Corstanje; Kim William Zerby; Steven W. Miller

(57) ABSTRACT

The present invention relates to a process for forming a cleaning composition containing the steps of providing at least one alkaline material and at least one acid active, and adding the acid active and the alkaline material to a mixer. The acid active is substantially neutralized within the mixer to form a neutralized detergent active. At least one acid-sensitive polymer is added to the neutralized detergent active to form a slurry, and the slurry is formed into a cleaning composition. A cleaning composition as formed by the above process is also described herein.

10 Claims, No Drawings

PROCESS FOR FORMING A CLEANING COMPOSITION

FIELD

The present invention relates to a process for making a cleaning composition, and a cleaning composition formed by said process. Specifically, the present invention relates to a process for making a cleaning composition containing a polymer, and a cleaning composition containing said polymer formed by said process.

BACKGROUND

A cleaning composition, especially a laundry composition, will typically contain an acidic species present during the production process. For example, the production process may utilize the acid active form of an anionic surfactant, which is neutralized during the production process. While certain anionic surfactants may be added as a pre-neutralized surfactant, in certain locales, such a pre-neutralized surfactant is either unavailable, of unreliable quality, or excessively expensive. Accordingly, a typical production process adds an acid active, and neutralizes it therein.

Polymers are commonly added to a cleaning composition to provide soil dispersion properties, anti-redeposition properties, fabric modification properties, etc. Such polymers may, for example, complex with soils to remove them from clothes, capture soils to reduce redeposition, and bind to fabric to provide a soft feel.

One type of polymer which is especially useful in a cleaning composition is a modified polyamine polymer. Such a modified polyamine polymer typically provides one or more of the desirable properties discussed above. Specifically, such a modified polyamine polymer may provide, for example, improved soil dispersion, anti-redeposition, and fabric modification properties. The modified polyamine polymer may contain, for example, additional charged or uncharged groups connected to a polymer backbone.

The desirable properties of these polymers typically depend upon their molecular weight and the properties of any chemically modified groups attached thereto. Such polymers, and especially modified polyamine polymers, are typically expensive, as compared to other detergent ingredients, and are thus used at relatively low concentrations. However, the properties noted above are typically concentration-dependent; the greater the concentration of the polymer, the greater the desired effect. Thus, it is desirable to add an effective concentration of the polymer, and yet keep this concentration low enough so as not to excessively increase the formulations cost of the cleaning composition.

Accordingly, the need remains for a process which incorporates a polymer into a cleaning composition at a concentration which maintains polymer properties and performance profiles without increasing formulation costs.

SUMMARY

It has now been found that an acid active present in a detergent production process may degrade certain polymers, causing them to disintegrate into lower molecular weight fragments which are significantly less effective in providing the desired polymer properties. Such a polymer is therefore described herein as an "acid-sensitive polymer." Thus, the present invention relates to an improved process for forming a cleaning composition containing an acid active and an acid-sensitive polymer, which reduces acid-sensitive polymer degradation and results in maintained polymer properties and performance profiles without increasing formulation costs.

The present invention relates to a process for forming a cleaning composition containing the steps of providing at least one alkaline material and at least one acid active, and adding the acid active and the alkaline material to a mixer. The acid active is substantially neutralized within the mixer to form a neutralized detergent active. At least one acid-sensitive polymer is added to the neutralized detergent active to form a slurry, and the slurry is formed into a cleaning composition. A cleaning composition as formed by the above process is also described herein.

These and other features, aspects, and advantages of the present invention will become evident to those skilled in the art from a reading of the present disclosure with the appended claims.

DETAILED DESCRIPTION

In accordance with the present invention it has now been found that a cleaning composition may utilize both an acid active and an acid-sensitive polymer and yet avoid acid-induced degradation of the acid-sensitive polymer. As there is no need to add extra acid-sensitive polymer in order to compensate for expected degradation, this improved process maintains the performance profile and benefits of the polymer without increasing formulation costs. This improved process reduces degradation, and therefore improves the effectiveness of a given amount of acid-sensitive polymer.

All percentages, ratios and proportions herein are by weight of the final cleaning composition, unless otherwise specified. All temperatures are in degrees Celsius (° C.), unless otherwise specified. All documents cited are incorporated herein by reference.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

The term "substantially neutralized", as used herein indicates that at least 50%, preferably at least 80%, and more preferably at least 85% of the acid active, by weight, has been neutralized.

In accordance with the present invention, it has been recognized that an acid active present in a typical cleaning composition production process may degrade certain polymers, causing them to disintegrate into lower molecular weight fragments which are significantly less effective. Such a polymer is therefore described herein as an "acid-sensitive polymer." Without intending to be limited by theory, it is believed that an acid active may react with the acid-sensitive polymer to cause it to degrade, or otherwise lose its effectiveness in the cleaning formulation. For example, an acid active may react with an active group on the acid-sensitive polymer to reduce the acid-sensitive polymer's properties in the cleaning composition. In another example, an acid active may react with the acid-sensitive polymer's backbone to cause it to hydrolyze and disintegrate into smaller fragments which are significantly less effective in a cleaning composition.

The present process also reduces undesirable polymerization of the acid-sensitive polymer. Without intending to be limited by theory, it is believed that certain acid-sensitive polymers may undesirably form homopolymers or copolymers when exposed to acid. Such undesirable polymerization may destroy or reduce the polymer's effectiveness and performance profile in the final composition.

Accordingly, the process of the present invention reduces such undesirable reactions by substantially neutralizing the acid active prior to adding the acid-sensitive polymer. Furthermore, this improved process also provides additional benefits. For example, as the acid-sensitive polymers are typically expensive, the present invention reduces formulation costs by requiring the addition of less acid-sensitive polymer to provide the same beneficial effects. Conversely, as the beneficial effects of such acid-sensitive polymers are typically dependent upon their concentration in the cleaning composition, the present process improves the overall effectiveness of a given level of acid-sensitive polymer.

In the process of the present invention, at least one alkaline material is provided with which to neutralize the acid active. The alkaline material may be any of those useful in a cleaning composition, and especially a laundry composition. The alkaline material is typically selected from the alkali metal and alkali earth metal salts of, for example, carbonate, phosphate, silicate, layered silicate, hydroxide, and mixtures thereof.

Preferred examples of the carbonate useful herein include the bicarbonates and sesquicarbonates, more preferably, sodium carbonate (i.e., soda ash), potassium carbonate, and mixtures thereof.

Where permitted, alkali and alkali earth metal phosphates are especially useful herein as they may serve the dual purpose of acting as an alkaline material, as well as a builder. If present, the builder may assist in controlling mineral hardness and in the removal of particulate soils. Preferred phosphates useful herein include, but are not limited to, the alkali metal, ammonium and alkanolammonium salts of polyphosphates (exemplified by the tripolyphosphates, pyrophosphates, and glassy polymeric meta-phosphates), phosphonates, and mixtures thereof.

The alkali metal and alkali earth metal silicate and layered silicate are also useful herein. Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to Rieck. NaSKS-6 is the trademark for a crystalline layered silicate marketed by Hoechst (commonly abbreviated herein as "SKS-6"). NaSKS-6 has the delta-$Na_2SiO_5$ morphology form of layered silicate. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The hydroxide useful herein is preferably sodium hydroxide, such as is used in a caustic neutralization process. Typically, an aqueous solution of caustic sodium hydroxide is added to the mixer, in order to neutralize the acid active.

The alkaline material useful herein is typically provided in the cleaning composition in at least a stoichiometric molar ratio sufficient to completely neutralize the acid active. Typically, the alkaline material is in stoichiometric excess. The stoichiometric molar ratio of alkaline material to acid active is at least 1:1, preferably at least 1.2:1. In certain processes, such as agglomeration processes, this stoichiometric molar ratio of alkaline material to acid active may reach 8:1, or more.

The present process also provides at least one acid active which is added to the mixer and neutralized by the alkaline material. The acid active useful herein is typically the acid form of an anionic surfactant.

The anionic surfactant useful herein typically includes the acid forms of sulfonated surfactants and sulfonated surface-active materials. Especially useful herein are the acid forms of conventional $C_{11}$–$C_{18}$ alkyl benzene sulfonates. Such alkyl benzene sulfonates may be either the branched alkyl sulfonates, the linear alkyl benzene sulfonates ("LAS"), or mixtures thereof. Typically, the sulfuric and/or sulfonic acid form of the desired anionic surfactant is provided. For example, to provide linear alkyl benzene sulfonate in the final cleaning composition, linear alkyl benzene sulfonic acid may be provided and neutralized in the process herein.

The process herein includes the step of adding the acid active and the alkaline material to a mixer. The acid active is then substantially neutralized within the mixer to form a neutralized detergent active. The types of mixer useful herein include both the commercially-available batch-type slurry mixers (also called a "crutcher"), or any type of liquid mixer. Such mixers may be operated continuously, for example, in a multi-stage process. The processing described herein may be performed in a single mixer, or multiple mixers as desired.

The acid active useful herein is typically provided at levels of from about 10% to about 65%, preferably from about 12% to about 45%, and more preferably from about 15% to about 35%, by weight of the final cleaning composition.

In a preferred embodiment of the process described herein, sodium silicate is added to the neutralized detergent active prior to adding the acid-sensitive polymer. Without intending to be limited by theory, it is believed that this insures an alkaline environment, so as to further prevent any residual acid active form degrading the acid-sensitive polymer.

An acid-sensitive polymer is also provided herein. The acid-sensitive polymer useful herein reacts with an acid active to reduce the effectiveness of the acid-sensitive polymer in the cleaning composition. As noted above, this reduction of effectiveness may result, for example, from chemical modification of the acid-sensitive polymer's active groups, from actual fragmentation of the acid-sensitive polymer's backbone, etc. Preferred acid-sensitive polymers useful herein include soil dispersion polymers, anti-redeposition polymers, and fabric conditioning polymers mixtures thereof. More preferred classes of polymers useful herein include modified polyamine polymers, polyacrylate polymers, copolymers of acrylic and maleic acids, and mixtures thereof.

Modified polyamine polymers are especially preferred herein as an acid-sensitive polymer. These polymers have shown a high susceptibility to acid-induced degradation when added with an acid active in the normal agglomeration processes. These modified polyamine polymers are even more preferably modified polyethyleneimine polymers which comprise either linear or cyclic backbones. The polyamine backbones can also comprise polyamine branching chains to a greater or lesser degree. In general, the polyamine backbones described herein are modified in such a manner that each nitrogen of the polyamine chain is thereafter described in terms of a unit that is substituted, quaternized, oxidized, or combinations thereof.

For the purposes of the present invention the term "modification" is defined as replacing a backbone —NH hydrogen atom by an E unit (substitution), quaternizing a backbone nitrogen (quaternized) or oxidizing a backbone nitrogen to the N-oxide (oxidized). The terms "modification" and "substitution" are used interchangeably when referring to the process of replacing a hydrogen atom attached to a backbone nitrogen with an E unit. Quaternization or oxidation may take place in some circumstances without substitution, but substitution is preferably accompanied by oxidation or quaternization of at least one backbone nitrogen.

The linear or non-cyclic polyamine backbones that comprise the modified polyethyleneimine polymers of the present invention have the general formula:

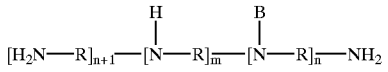

said backbones prior to subsequent modification, comprise primary, secondary and tertiary amine nitrogens connected by R "linking" units. The cyclic polyamine backbones comprising the modified polyethyleneimine polymers of the present invention have the general formula:

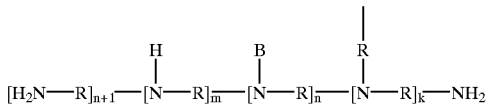

said backbones prior to subsequent modification, comprise primary, secondary and tertiary amine nitrogens connected by R "linking" units For the purpose of the present invention, primary amine nitrogens comprising the backbone or branching chain once modified are defined as V or Z "terminal" units. For example, when a primary amine moiety, located at the end of the main polyamine backbone or branching chain having the structure:

$H_2N—R]—$ is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure:

$—NH_2$ is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the backbones and branching chains of the present invention, having the structure:

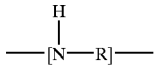

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, wherein B represents a continuation of the chain structure by branching, having the structure:

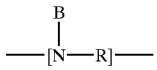

is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the modified polyethyleneimine polymers of the present invention can be therefore represented by the general formula:

$$V_{(n+1)}W_mY_nZ$$

for linear modified polyethyleneimine polymers and by the general formula:

$$V_{(n-k+1)}W_mY_nY'_kZ$$

for cyclic modified polyethyleneimine polymers. For the case of modified polyethyleneimine polymers comprising rings, a Y' unit of the formula:

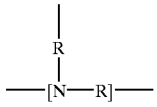

serves as a branch point for a backbone or branch ring. For every Y' unit there is a Y unit having the formula:

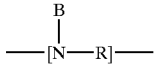

that will form the connection point of the ring to the main polymer chain or branch. In the unique case where the backbone is a complete ring, the polyamine backbone has the formula:

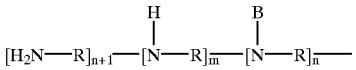

therefore comprising no Z terminal unit and having the formula:

$$V_{n-k}W_mY_nY'_k$$

wherein k is the number of ring forming branching units. Preferably the polyamine backbones of the present invention comprise no rings.

In the case of non-cyclic modified polyethyleneimine polymers, the ratio of the index n to the index m relates to the relative degree of branching. A fully non-branched linear modified polyethyleneimine polymer according to the present invention has the formula:

$$VW_mZ$$

that is, n is equal to 0. The greater the value of n (the lower the ratio of m to n), the greater the degree of branching in the molecule. Typically the value for m ranges from a minimum value of 4 to about 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, or Z units depending on whether they are primary, secondary or tertiary nitrogens. That is unmodified primary amine nitrogens are V or Z units, unmodified secondary amine nitrogens are W units and unmodified tertiary amine nitrogens are Y units for the purposes of the present invention.

Modified primary amine moieties are defined as V "terminal" units having one of three forms:

a) simple substituted units having the structure:

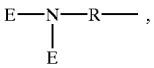

b) quaternized units having the structure:

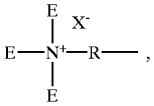

wherein X is a suitable counter ion providing charge balance; and c) oxidized units having the structure:

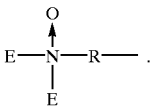

Modified secondary amine moieties are defined as W "backbone" units having one of three forms:

a) simple substituted units having the structure:

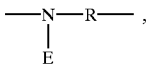

b) quatemized units having the structure:

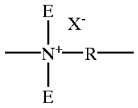

wherein X is a suitable counter ion providing charge balance; and c) oxidized units having the structure:

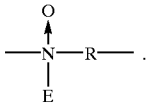

Modified tertiary amine moieties are defined as Y "branching" units having one of three forms:

a) unmodified units having the structure:

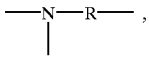

b) quaternized units having the structure:

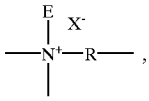

wherein X is a suitable counter ion providing charge balance; and c) oxidized units having the structure:

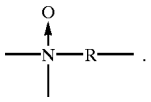

Certain modified primary amine moieties are defined as Z "terminal" units having one of three forms:

a) simple substituted units having the structure:

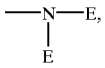

b) quaternized units having the structure:

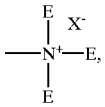

wherein X is a suitable counter ion providing charge balance; and c) oxidized units having the structure:

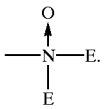

When any position on a nitrogen is unsubstituted of unmodified, it is understood that hydrogen will substitute for E. For example, a primary amine unit comprising one E unit in the form of a hydroxyethyl moiety is a V terminal unit having the formula:

$(HOCH_2CH_2)HN$—.

For the purposes of the present invention there are two types of chain terminating units, the V and Z units. The Z "terminal" unit derives from a terminal primary amino moiety of the structure —$NH_2$. Non-cyclic polyamine backbones according to the present invention comprise only one Z unit whereas cyclic polyamines can comprise no Z units. The Z "terminal" unit can be substituted with any of the E units described further herein below, except when the Z unit is modified to form an N-oxide. In the case where the Z unit nitrogen is oxidized to an N-oxide, the nitrogen must be modified and therefore E cannot be a hydrogen.

The modified polyethyleneimine polymers of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety may take any position on the R unit chain except the carbon atoms directly connected to the polyamine backbone nitrogens; $C_4$–$C_{12}$ dihydroxyalkylene wherein the hydroxyl moieties may occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula:

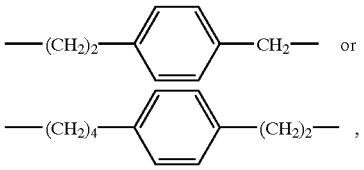

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise—$(R^1O)_xR^5(OR^1)_x$—, —$CH_2CH(OR^2)CH_2O)_z(R^1O)_yR^1(OCH_2CH(OR^2)CH_2)_w$—, —$CH_2CH(OR^2)CH_2$—, —$(R^1O)_xR^1$—, and mixtures thereof. Preferred R units are $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, —$(R^1O)_xR^1$—, —$CH_2CH(OR^2)CH_2$—, —$(CH_2CH(OH)CH_2O)_z(R^1O)_yR^1(OCH_2CH$—$(OH)CH_2)_w$—, —$(R^1O)_xR^5(OR^1)_x$—, more preferred R units are $C_2$–$C_{12}$ alkylene, $C_3$–$C_{12}$ hydroxy-alkylene, $C_4$–$C_{12}$ dihydroxyalkylene, —$(R^1O)_xR^1$—, —$(R^1O)_xR^5(OR^1)_x$—, —$(CH_2CH(OH)CH_2O)_z(R^1O)_yR^1(OCH_2CH$—$(OH)CH_2)_w$—, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

$R^1$ units are $C_2$–$C_6$ alkylene, and mixtures thereof, preferably ethylene. $R^2$ is hydrogen, and —$(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof , preferably $C_1$–$C_{12}$ alkyl, $C_7$–$C_{12}$ arylalkylene, more preferably $C_1$–$C_{12}$ alkyl, most preferably methyl. $R^3$ units serve as part of E units described herein below.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —C(O)$NHR^6NHC$ —(O)—, —C(O)$(R^4)_rC(O)$—, —$R^1(OR^1)$—, —$CH_2CH(OH)CH_2O(R^1O)_yR^1OCH_2CH(OH)CH_2$—, —C(O)$(R^4)_rC$ (O)—, —$CH_2CH(OH)CH_2$—, $R^5$ is preferably ethylene, —C(O)—, —C(O) $NHR^6NHC(O)$—, —$R^1(OR^1)$—, —$CH_2CH(OH)CH_2$—, —$CH_2CH$ (OH) $CH_2O(R^1O)_yR^1OCH_2CH$—(OH)$CH_2$—, more preferably—$CH_2CH(OH)CH_2$—.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred modified polyethyleneimine polymers of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —$(CH_2CH_2O)_xR^5(OCH_2CH_2)_x$—yields —$(CH_2CH_2O)_xCH_2CHOHCH_2(OCH_2CH_2)_x$—.

ii) Substituting preferred $R^1$ and $R^2$ into —$(CH_2CH(OR^2)CH_2O)_z$—$(R^1O)_yR^1O(CH_2CH(OR^2)CH_2)_w$— yields —$(CH_2CH(OH)CH_2O)_z$—$(CH_2CH_2O)_yCH_2CH_2O(CH_2CH(OH)CH_2)_w$—.

iii) Substituting preferred $R^2$ into —$CH_2CH(OR^2)CH_2$— yields —$CH_2CH(OH)CH_2$—.

E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_mB$, —C(O)$R^3$, preferably hydrogen, $C_2$–$C_{22}$ hydroxyalkylene, benzyl, $C_1$–$C_{22}$ alkylene, —$(R^1O)_mB$, —C(O)$R^3$, —$(CH_2)_pCO_2M$, —$(CH_2)_qSO_3M$, —$CH(CH_2CO_2M)CO_2M$, more preferably $C_1$–$C_{22}$ alkylene, —$(R^1O)_xB$, —C(O)$R^3$, —$(CH_2)_pCO_2M$, —$(CH_2)_qSO_3M$, —$CH(CH_2CO_2M)CO_2M$, most preferably $C_1$–$C_{22}$ alkylene, —$(R^1O)_xB$, and —C(O)$R^3$. When no modification or substitution is made on a nitrogen then hydrogen atom will remain as the moiety representing E.

E units do not comprise hydrogen atom when the V, W or Z units are oxidized, that is the nitrogens are N-oxides. For example, the backbone chain or branching chains do not comprise units of the following structure:

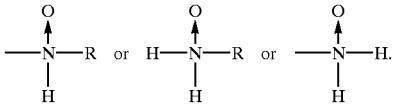

Additionally, E units do not comprise carbonyl moieties directly bonded to a nitrogen atom when the V, W or Z units are oxidized, that is, the nitrogens are N-oxides. According to the present invention, the E unit —C(O)$R^3$ moiety is not bonded to an N-oxide modified nitrogen, that is, there are no N-oxide amides having the structure:

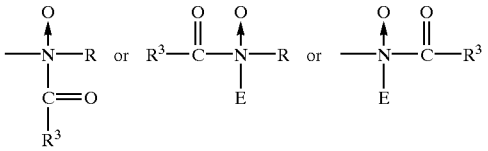

or combinations thereof.

B is hydrogen, $C_1$–$C_6$ alkyl, —$(CH_2)_qSO_3M$, —$(CH_2)_pCO2M$, —$(CH_2)$ q—$(CHSO_3M)CH_2SO_3M$, —$(CH_2)_q(CHSO_2M)CH_2SO_3M$, —$(CH_2)_pPO_3M$, —$PO_3M$, preferably hydrogen, —$(CH_2)_qSO_3M$, —$(CH_2)_q(CHSO_3M)CH_2SO_3M$, —$(CH_2)_q$—$(CHSO_2M)CH_2SO_3M$, more preferably hydrogen or —$(CH_2)_qSO_3M$.

M is hydrogen or a water soluble cation in sufficient amount to satisfy charge balance. For example, a sodium cation equally satisfies —$(CH_2)_pCO_2M$, and —$(CH_2)_qSO_3M$, thereby resulting in —$(CH_2)_pCO_2Na$, and —$(CH_2)_qSO_3Na$ moieties. More than one monovalent cation, (sodium, potassium, etc.) can be combined to satisfy the required chemical charge balance. However, more than one anionic group may be charge balanced by a divalent cation, or more than one monovalent cation may be necessary to satisfy the charge requirements of a poly-anionic radical. For example, a —$(CH_2)_pPO_3M$ moiety substituted with sodium atoms has the formula —$(CH_2)_pPO_3Na_3$. Divalent cations such as calcium ($Ca^{2+}$) or magnesium ($Mg^{2+}$) may be substituted for or combined with other suitable monovalent water soluble cations. Preferred cations are sodium and potassium, more preferred is sodium.

X is a water soluble anion such as chlorine ($Cl^-$), bromine ($Bi^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; m has the value from 4 to about 400, n has the value from 0 to about 200; m+n has the value of at least 5.

The preferred modified polyethyleneimine polymers of the present invention comprise polyamine backbones wherein less than about 50% of the R groups comprise "oxy" R units, preferably less than about 20% , more preferably less than 5%, most preferably the R units comprise no "oxy" R units.

The most preferred modified polyethyleneimine polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The modified polyethyleneimine polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone. The proper manipulation of these "R unit chain lengths" provides the formulator with the ability to modify the solubility and fabric substantivity of the modified polyethyleneimine polymers of the present invention.

Preferred modified polyethyleneimine polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Preferred amine polymer backbones comprise R units that are $C_2$ alkylene (ethylene) units, also known as polyethyleneimines (PEI's). Preferred PEI's have at least moderate branching, that is the ratio of m to n is less than 4:1, however PEI's having a ratio of m to n of about 2:1 are most preferred. Preferred backbones, prior to modification have the general formula:

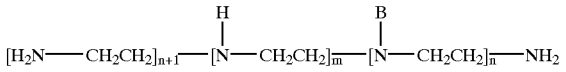

wherein m and n are the same as defined herein above. Preferred PEI's, prior to modification, will have a molecular weight greater than about 200 Daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These modified polyethyleneimine polymers can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of modified polyethyleneimine polymers of the present invention comprising PEI's, are illustrated in Formulas I–IV:

Formula I depicts a modified polyethyleneimine polymer comprising a PEI backbone wherein all substitutable nitrogens are modified by replacement of hydrogen with a polyoxyalkyleneoxy unit, —$(CH_2CH_2O)_7H$, having the formula:

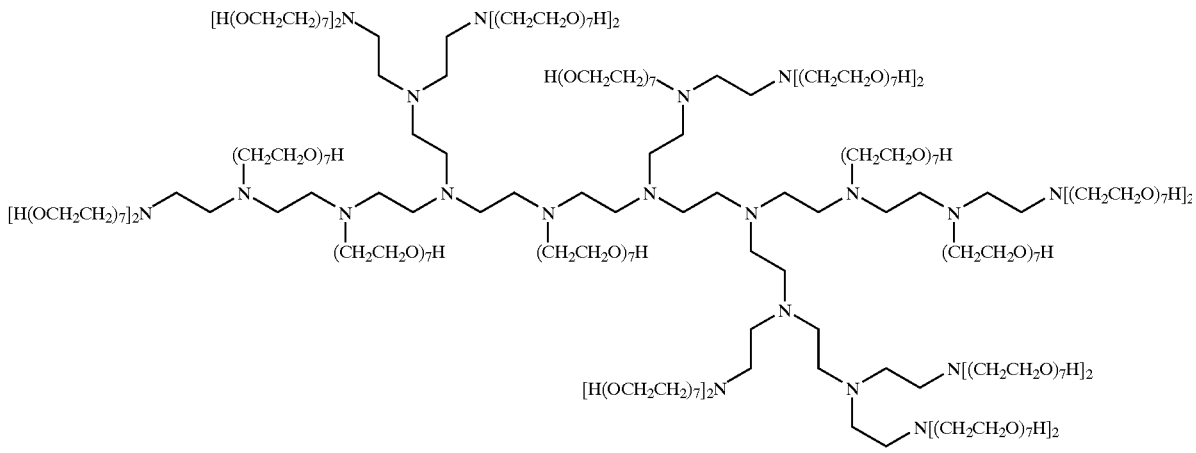

Formula I

This is an example of a modified polyethyleneimine polymer that is fully modified by one type of moiety.

Formula II depicts a modified polyethyleneimine polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, said modified polyethyleneimine polymer having the formula:

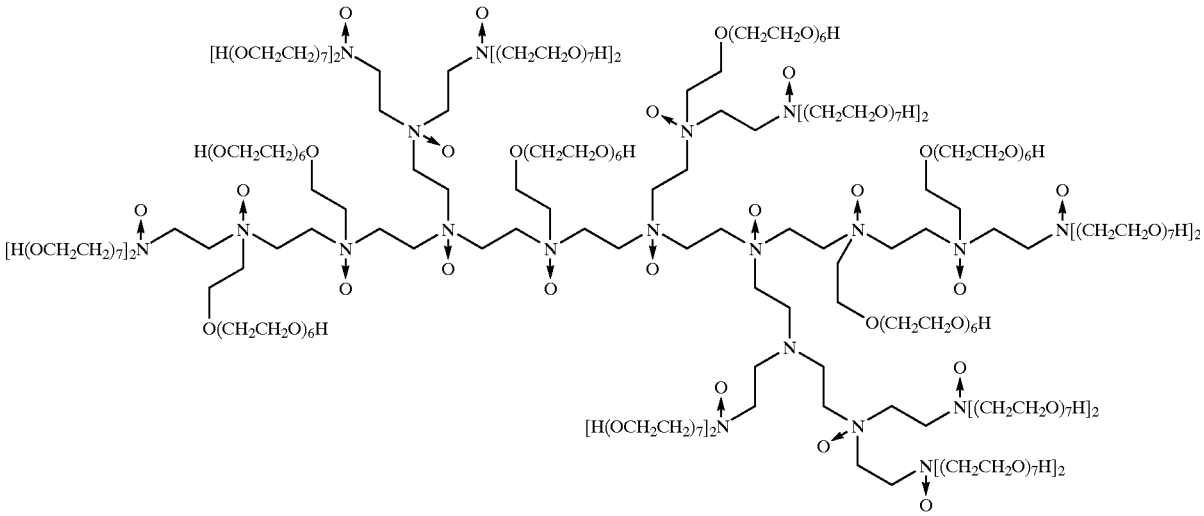

Formula II

Formula III depicts a modified polyethyleneimine polymer comprising a PEI backbone wherein all backbone hydrogen atoms are substituted and some backbone amine units are quaternized. The substituents are polyoxyalkyleneoxy units, —$(CH_2CH_2O)_7H$, or methyl groups. The modified PEI soil release polymer has the formula:

Formula III

Formula IV depicts a modified polyethyleneimine polymer comprising a PEI backbone wherein the backbone nitrogens are modified by substitution (i.e. by —$(CH_2CH_2O)_7H$ or methyl), quaternized, oxidized to N-oxides or combinations thereof. The resulting modified polyethyleneimine polymer has the formula:

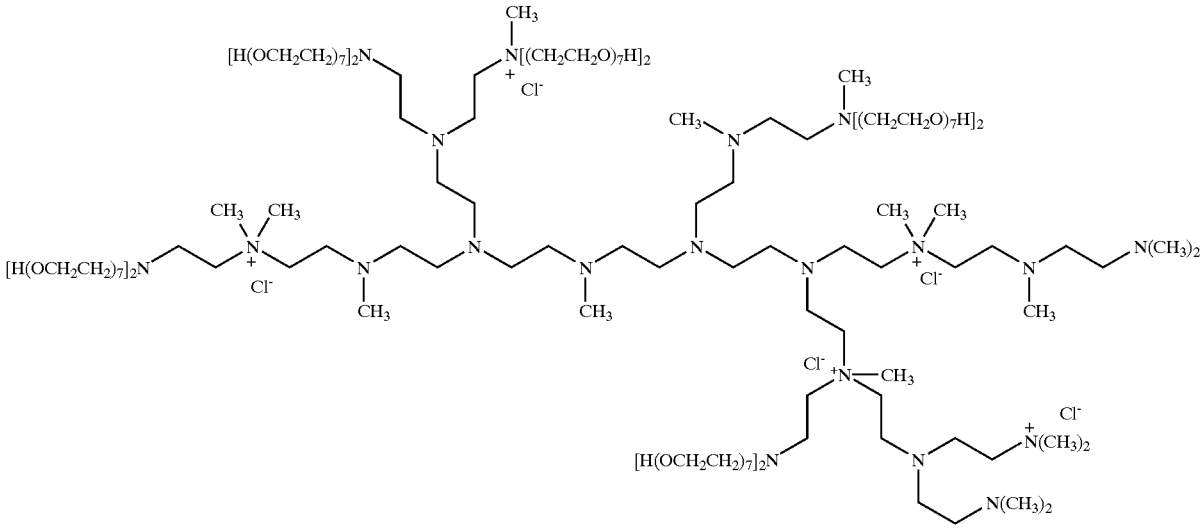

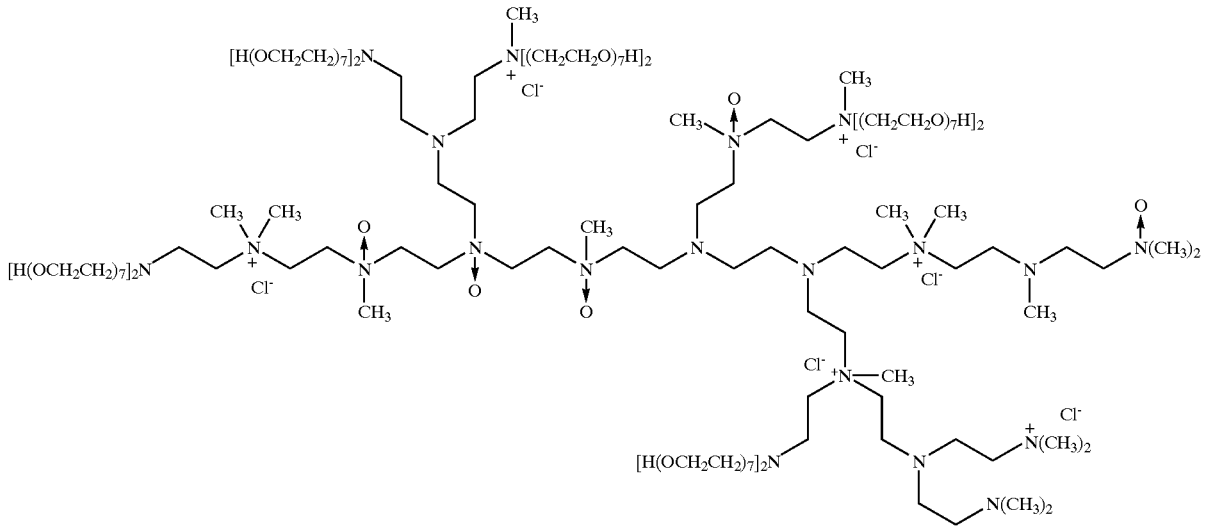

Formula IV

In the above examples, not all nitrogens of a unit class comprise the same modification. The present invention allows the formulator to have a portion of the secondary amine nitrogens ethoxylated while having other secondary amine nitrogens oxidized to N-oxides. This also applies to the primary amine nitrogens, in that the formulator may choose to modify all or a portion of the primary amine nitrogens with one or more substituents prior to oxidation or quaternization. Any possible combination of E groups can be substituted on the primary and secondary amine nitrogens, except for the restrictions described herein above.

The acid-sensitive polymer useful herein is typically provided at levels of from about 0.05% to about 15%, preferably from about 0.1% to about 10%, and more preferably from about 0.2% to about 7%, by weight of the cleaning composition. If the acid-sensitive polymer herein is a modified polyethyleneimine polymer, it is typically provided at levels of from about 0.05% to about 2%, preferably from about 0.1% to about 1%, and more preferably from about 0.2% to about 0.8%, by weight of the cleaning composition.

In a preferred embodiment of the present invention, a carrier is provided, in which the acid-sensitive polymer is dispersed to form a premix. Because the acid-sensitive polymer is typically either a solid or a viscous liquid, and because of the typically low concentration at which the acid-sensitive polymer is used, a carrier is usually required in order to evenly disperse the acid-sensitive polymer throughout the neutralized detergent active. The carrier is typically a liquid, and may either serve only as a carrier, or may serve a dual purpose. As the acid-sensitive polymer is to be dispersed therein to form the premix, the carrier is preferably non-acidic, such as water. Also useful herein is a non-aqueous carrier, or a basic carrier.

Enough carrier must be provided such that the acid-sensitive polymer is easily dispersed, preferably dissolved, therein to form the premix. The weight ratio of carrier to acid-sensitive polymer in the premix is typically at least about 1:1, preferably from about 1:1 to about 8:1.

The acid-sensitive polymer or, in a preferred embodiment, the premix containing the acid-sensitive polymer, is added to the neutralized detergent active to form a slurry. This typically takes place within a mixer or apparatus which homogenizes the slurry. The mixer may be the same mixer used in the previous neutralization step, or a different mixer. The slurry is then formed into a cleaning composition by, for example, spray drying, or agglomeration processes known in the art.

In a preferred process, the slurry is formed into spray-dried granules in a conventional spray drying tower operated at an inlet temperature range of from about 180° C. to about 450° C. Such a known apparatus operates by spraying the slurry via nozzles into a counter-current (or co-current) stream of hot air which dries the slurry and ultimately forms porous spray-dried granules.

Examples of the invention are set forth hereinafter by way of illustration and are not intended to be in any way limiting of the invention.

EXAMPLE 1

A cleaning composition is formed according to the following process. About 20–25% acid active corresponding to the acid form of LAS is provided. About 1.2 times the stoichiometrically-required amount of dilute caustic hydroxide solution is provided to neutralize the acid active. The acid active and the alkaline material are added to a mixer, and neutralized therein to form a neutralized detergent active. About 8% silicate is also added to the neutralized detergent active. An acid-sensitive polymer (a modified polyethyleneimine polymer, having a backbone of MW 1800 and a degree of ethoxylation of about 7) is provided and mixed with water at a weight ratio of about 1:1 to about 8:1 to form a premix. The premix is then added to the mixer, where it is mixed for about 10 seconds to form a slurry. Other detergent ingredients, such as phosphate, sulfate, etc. are also added at this point.

The slurry is then dumped into a drop tank and pumped at a pressure of from 40–70 bar, through a pressure nozzle in a spray tower to form spray-dried granules. The spray tower employs counter-current airflow with an inlet temperature of about 320–350° C.

What is claimed is:

1. A process for forming a cleaning composition comprising the steps of:

A. providing at least one alkaline material and at least one acid active;

B. adding the acid active and the alkaline material to a mixer;

C. substantially neutralizing the acid active in the mixer to form a neutralized detergent active;

D. adding at least one acid-sensitive polymer to the neutralized detergent active to form a slurry; and E. forming the slurry into a cleaning composition.

2. The process of claim 1, wherein the acid-sensitive polymer comprises a polyamine backbone prior to modification via quaternization, substitution, or oxidation corresponding to the formula:

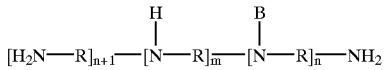

having a modified polyamine formula $V_{(n+1)}W_mY_nZ$ or a polyamine backbone prior to modification via quaternization, substitution, or oxidation corresponding to the formula:

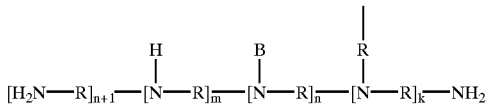

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

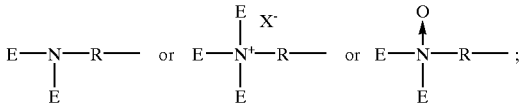

ii) W units are backbone units having the formula:

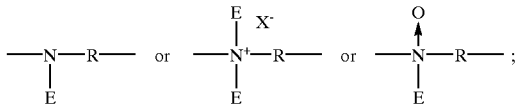

iii) Y and Y' units are branching units having the formula:

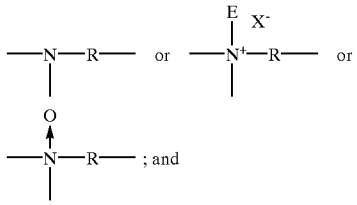

iv) Z units are terminal units having the formula:

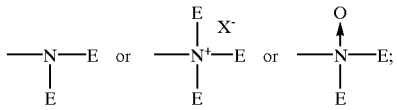

;

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarytene, $—(R^1O)_xR^1—$, $—(R^1O)_xR^5(OR^1)_x—$, $—(CH_2CH(OR^2)CH_2O)_z(R^1O)_yR^1(OCH_2CH(OR^2)CH_2)_w—$, $—C(O)(R^4)_rC(O)—$, $—CH_2CH(OR^2)CH_2—$, and mixtures thereof; wherein $R^1$ is $C_2$–$C_6$ alkylene and mixtures thereof; $R^2$ is hydrogen, $—(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, $—C(O)—$, $—C(O)NHR^6NHC(O)—$, $—R^1(OR^1)—$, $—C(O)(R^4)_rC(O)—$, $—CH_2CH(OH)CH_2—$, $—CH_2CH(OH)CH_2O(R^1O)_yR^1OCH_2CH(OH)CH_2—$, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, $—(CH_2)_pCO_2M$, $—(CH_2)_qSO_3M$, $—CH(CH_2CO_2M)CO_2M$, $—(CH_2)_pPO_3M$, $—(R^1O)_xB$, $—C(O)R^3$, and mixtures thereof; provided that when any E unit of a nitrogen is a hydrogen, said nitrogen is not an N-oxide; B is hydrogen, $C_1$–$C_6$ alkyl, $—(CH_2)_qSO_3M$, $—(CH_2)_pCO_2M$, $—(CH_2)_q(CHSO_3M)CH_2SO_3M$, $—(CH_2)_q—(CHSO_2M)CH_2SO_3M$, $—(CH_2)_pPO_3M$, $—PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1.

3. The process of claim 1, further comprising the step of dispersing the acid-sensitive polymer in a carrier to form a premix prior to forming the slurry.

4. The process of claim 1 further comprising the step of spray drying the slurry to form a cleaning composition.

5. The process of claim 1, further comprising the step of adding sodium silicate to the neutralized detergent active before forming the slurry.

6. The process of claim 1, wherein the alkaline material is selected from the group consisting of a carbonate, a phosphate, silicate, layered silicate, hydroxide, and mixtures thereof.

7. A cleaning composition as formed by the process of claim 1.

8. The process of claim 3, wherein the weight ratio of carrier to acid-sensitive polymer is at least about 1:1.

9. The process of claim 3, wherein the carrier comprises water.

10. A process for forming a cleaning composition comprising the steps of:

A. providing at least one alkaline material and at least one acid active;

B. adding the acid active and the alkaline material to a mixer, the alkaline material being selected from the group consisting of a carbonate, a phosphate, silicate, layered silicate, hydroxide, and mixtures thereof;

C. substantially neutralizing the acid active in the mixer to form a neutralized detergent active;

D. dispersing the acid-sensitive polymer in a carrier to form a premix;

E. adding the premix to the neutralized detergent active to form a slurry; and

F. forming the slurry into a cleaning composition, wherein the weight ratio of carrier to acid-sensitive polymer is at least 1:1, and wherein the acid-sensitive polymer comprises a polyamine backbone prior to modification via quaternization, substitution, or oxidation corresponding to the formula:

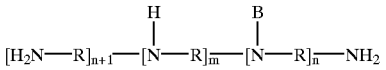

;

having a modified polyamine formula $V_{(n+1)}W_mY_nZ$ or a polyamine backbone prior to modification via quaternization, substitution, or oxidation corresponding to the formula:

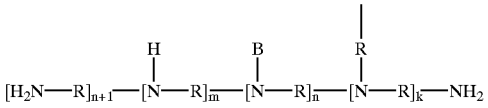

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

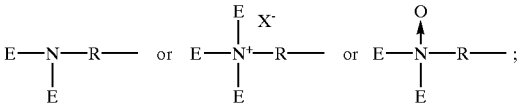

ii) W units are backbone units having the formula:

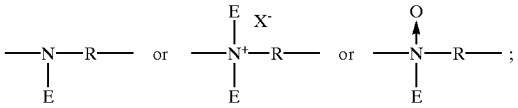

iii) Y and Y' units are branching units having the formula:

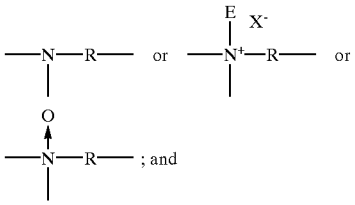

; and iv) Z units are terminal units having the formula:

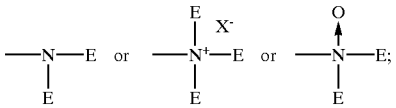

;

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —C(O)$NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; provided that when any E unit of a nitrogen is a hydrogen, said nitrogen is not an N-oxide; B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1.

* * * * *